US011910932B2

(12) United States Patent
Weber et al.

(10) Patent No.: US 11,910,932 B2
(45) Date of Patent: Feb. 27, 2024

(54) MOTION CHAIR

(71) Applicant: American Leather Operations, LLC, Dallas, TX (US)

(72) Inventors: Jeff Weber, Minneapolis, MN (US); Anders Larsen, Dallas, TX (US); Douglas L. Gasal, Dallas, TX (US); Jared Hurd, Dallas, TX (US); Robert B. Duncan, Dallas, TX (US); Kevin Nguyen, Carrollton, TX (US)

(73) Assignee: American Leather Operations, LLC, Dallas, TX (US)

( * ) Notice: Subject to any disclaimer, the term of this patent is extended or adjusted under 35 U.S.C. 154(b) by 0 days.

(21) Appl. No.: 18/108,760

(22) Filed: Feb. 13, 2023

(65) Prior Publication Data

US 2023/0189996 A1 Jun. 22, 2023

Related U.S. Application Data

(63) Continuation of application No. 17/186,859, filed on Feb. 26, 2021, now Pat. No. 11,583,085, which is a continuation of application No. 16/381,068, filed on Apr. 11, 2019, now Pat. No. 11,006,754.

(60) Provisional application No. 62/656,608, filed on Apr. 12, 2018.

(51) Int. Cl.

| | |
|---|---|
| ***A47C 3/026*** | (2006.01) |
| ***A47C 1/024*** | (2006.01) |
| ***A47C 3/025*** | (2006.01) |
| ***A47C 7/14*** | (2006.01) |

(52) U.S. Cl.

CPC ..... *A47C 3/026* (2013.01); *A47C 1/024* (2013.01); *A47C 3/0252* (2013.01); *A47C 3/0255* (2013.01); *A47C 7/144* (2018.08)

(58) Field of Classification Search

CPC ..... A47C 7/14; A47C 3/026; A47C 3/0252; A47C 3/0255

See application file for complete search history.

(56) References Cited

U.S. PATENT DOCUMENTS

| | | | |
|---|---|---|---|
| 293,139 | A | 2/1884 | Bohlig |
| 2,184,988 | A | 12/1939 | Collier |
| 2,283,000 | A | 5/1942 | Feldman |
| 2,296,603 | A | 9/1942 | Feldman |
| 2,567,611 | A | 9/1951 | Burnard |
| 2,616,484 | A | 11/1952 | Christie |

(Continued)

FOREIGN PATENT DOCUMENTS

| | | | |
|---|---|---|---|
| CA | 2688893 | A1 | 6/2011 |
| CN | 1933749 | A | 3/2007 |

(Continued)

OTHER PUBLICATIONS

Chinese Office Action for Application No. 201910292771.5, dated Apr. 15, 2022, 18 pages.

*Primary Examiner* — Timothy J Brindley
(74) *Attorney, Agent, or Firm* — Womble Bond Dickinson (US) LLP

(57) ABSTRACT

A motion seat is described that includes a chassis, a seat frame, a seat cushion, a backrest, and a resilient hinge. The seat frame is attached to the chassis and the seat cushion and the backrest are each attached to the seat frame. The resilient hinge formed as a unitary body and may be formed from a resilient polymer. The seat cushion and/or the backrest is pivotably attached to the seat frame with the resilient hinge.

10 Claims, 11 Drawing Sheets

(56) References Cited

U.S. PATENT DOCUMENTS

| | | | |
|---|---|---|---|
| 3,198,473 | A | 8/1965 | Holz |
| 3,315,666 | A | 4/1967 | Sellner |
| 3,641,995 | A | 2/1972 | Brandt |
| 3,761,081 | A | 9/1973 | Simmons |
| 3,770,235 | A | 11/1973 | Klapproth |
| 3,863,982 | A | 2/1975 | Sandham |
| 4,195,883 | A | 4/1980 | Ronnhult et al. |
| 4,632,450 | A | 12/1986 | Holdt |
| 4,790,599 | A | 12/1988 | Goldman |
| 4,852,943 | A | 8/1989 | Roper |
| 4,890,886 | A | 1/1990 | Opsvik |
| 5,098,158 | A | 3/1992 | Palarski |
| 5,288,127 | A | 2/1994 | Berg |
| 5,320,410 | A | 6/1994 | Falks |
| 5,348,367 | A | 9/1994 | Mizelle |
| 5,486,035 | A | 1/1996 | Koepke et al. |
| 5,601,331 | A | 2/1997 | Austin et al. |
| 5,618,016 | A | 4/1997 | Garland |
| 5,649,740 | A | 7/1997 | Hodgton |
| 6,048,029 | A | 4/2000 | Percoco |
| 6,050,642 | A | 4/2000 | Erb |
| 6,209,958 | B1 | 4/2001 | Thole |
| 6,244,658 | B1 | 6/2001 | Parent et al. |
| 6,318,803 | B1 | 11/2001 | Garland |
| 6,435,611 | B1 | 8/2002 | Walter |
| 6,464,295 | B1 | 10/2002 | Bergeron |
| 6,601,818 | B1 | 8/2003 | Larsen |
| 6,612,651 | B1 | 9/2003 | Garland |
| 6,644,743 | B1 | 11/2003 | Lin |
| 6,685,268 | B2 | 2/2004 | Meyer |
| 6,827,401 | B2 | 12/2004 | Marshall |
| 6,899,393 | B2 | 5/2005 | Garland |
| 6,979,059 | B1 | 12/2005 | Conlin |
| 7,850,238 | B2 | 12/2010 | Erb et al. |
| 8,657,375 | B2 | 2/2014 | LaPointe |
| 8,888,184 | B2 | 11/2014 | Meyer |
| 9,480,336 | B1 | 11/2016 | Garland et al. |
| 9,668,585 | B2 | 6/2017 | Garland |
| 9,814,321 | B2 | 11/2017 | Garland |
| 9,839,296 | B2 | 12/2017 | Baliendat |
| 9,975,458 | B2 | 5/2018 | Takeuchi |
| 10,548,406 | B2 | 2/2020 | Garland |
| 11,006,754 | B2 | 5/2021 | Weber et al. |
| 11,583,085 | B2 | 2/2023 | Weber et al. |
| 2003/0052521 | A1 | 3/2003 | Nelson et al. |
| 2004/0178665 | A1 | 9/2004 | May |
| 2005/0146184 | A1 | 7/2005 | Machael et al. |
| 2005/0218707 | A1 | 10/2005 | Suhr et al. |
| 2006/0290174 | A1 | 12/2006 | Hoffman et al. |
| 2007/0252419 | A1 | 11/2007 | Takahashi |
| 2009/0189424 | A1 | 7/2009 | Chi |
| 2009/0195040 | A1 | 8/2009 | Birkbeck |
| 2011/0148161 | A1 | 6/2011 | Fontaine |
| 2013/0113253 | A1 | 5/2013 | Meyer et al. |
| 2014/0327282 | A1 | 11/2014 | Crum |
| 2016/0235205 | A1 | 8/2016 | Ballendat et al. |
| 2016/0360889 | A1 | 12/2016 | Matlin et al. |
| 2017/0086590 | A1 | 3/2017 | Fujita et al. |
| 2018/0116402 | A1 | 5/2018 | Klokk et al. |
| 2019/0045928 | A1 | 2/2019 | Yajima et al. |
| 2019/0110604 | A1 | 4/2019 | Garland |
| 2019/0208910 | A1 | 7/2019 | Sugano et al. |
| 2019/0223599 | A1 | 7/2019 | Garland |
| 2020/0054143 | A1 | 2/2020 | Garland |

FOREIGN PATENT DOCUMENTS

| | | | |
|---|---|---|---|
| CN | 102123690 | A | 7/2011 |
| CN | 102669972 | A | 9/2012 |
| CN | 201910292771.5 | | 4/2019 |
| CN | 110367725 | A | 10/2019 |
| EP | 0135865 | A3 | 12/1985 |
| GB | 1437678 | A | 6/1976 |
| KR | 101106197 | B1 | 1/2012 |
| WO | 2017078145 | A1 | 5/2017 |

MOTION CHAIR

CROSS-REFERENCE TO RELATED APPLICATION

This application is a continuation of U.S. patent application Ser. No. 17/186,859, filed Feb. 26, 2021, which is a continuation of U.S. patent application Ser. No. 16/381,068, now U.S. Pat. No. 11,006,754, filed Apr. 11, 2019, which claimed the benefit of, and priority to U.S. Provisional Patent Application No. 62/656,608, filed Apr. 12, 2018. The entire contents of each of the above applications are hereby incorporated by reference.

FIELD OF THE DISCLOSURE

The present disclosure relates to furniture, particularly seating, and more particularly upholstered seating for home furnishing or hospitality furnishing purposes, capable of motion among multiple positions.

BACKGROUND

Shoppers for home furnishing have traditionally been provided with three principle options when in search of upholstered seating. The first type is stationary seating. Stationary chairs have been known for centuries and have been designed in a vast array of styles to meet the owner's preferred aesthetic. Stationary chairs, however often do not meet more modern desires for comfort when used continuously for a long period of time.

The second and third types of upholstered chairs, gliders, and recliners respectively, may be combined into the category of motion seating, which is seating designed to be capable of achieving at least two distinct positions. Gliders, which can include rocking chairs, are designed to receive the user, and are capable of forward and backward oscillating motion. Typically, the angle between the seat cushion and the back cushion is fixed in a glider or rocker style chair. Rocking motion has been shown to provide several physical and mental health benefits, including increased balance, improved muscle tone, and pain management/reduction. Rocking is also well-known to help sooth colic in babies.

Reclining furniture, on the other hand, is able to adjust the angle between the seat cushion and the back cushion to allow the user to assume a reclined position, often with the assistance of a footrest extending from below a recliner style chair. Reclining reduces the load on the spine and surrounding musculature. This enables the human back to rest, invoking general physical and mental relaxation. Recliners, however, typically do not provide the oscillating motion available from a glider. Further, while powered recliners can often provide infinite adjustment of the reclining angle, these seats do not conform naturally to the user as the user shifts in the chair.

There is a desire to create a seat, particularly an upholstered chair for furnishing a home or hospitality environment, that can naturally adjust to the position of the user without complex motors or actuators while combining the benefits of reclining furniture and gliding furniture.

SUMMARY

In an embodiment of the present disclosure, a seat includes a chassis, a seat frame, a seat cushion, a backrest, a first swing arm, and a second swing arm. The seat cushion is pivotably attached to the seat frame and the backrest is pivotably attached to the seat frame. The first swing arm has a top end and a bottom end. The top end is pivotably attached to the chassis at a first stationary pivot joint and the bottom end is pivotably attached to the seat frame at a first floating pivot joint. The second swing arm has a top end and a bottom end. The top end is pivotably attached to the chassis at a second stationary pivot joint and the bottom end is pivotably attached to the set frame at a second floating pivot joint such that the seat frame is capable of a swinging motion relative to the chassis along a forward to backward direction of the seat.

In embodiments, the first swing arm is forward of the second swing arm. A distance between the first stationary pivot joint and the first floating pivot joint may be greater than a distance between the secondary pivot point and the second floating pivot joint. A predetermined distance between the first and secondary stationary pivot points may be greater than a predetermined distance between the first and second floating pivot joints.

In some embodiments, the seat frame has a forwardmost and a rearwardmost position relative to the chassis. The seat frame may be biased towards the forwardmost position. The seat may include a spring that is configured to bias the seat frame to the forwardmost position.

In certain embodiments, the seat includes a damper that is configured to limit the swinging motion of the seat frame relative to the chassis in at least one direction. The damper may include a stop and a cushioner. The cushioner may be formed form a resilient material and may include a hollow portion with a convex exterior wall. The convex exterior wall may be configured to be inverted by the stop to slow motion of the seat frame in the at least one direction. The cushioner may define an aperture that is configured to receive a bolt to attach the cushioner to the chassis. The aperture may be offset from a centerline of the cushioner. The centerline may be parallel with the forward to backward direction of the seat. The cushioner may be mounted to the chassis such that a peripheral wall thereof that does not contact the stop is able to deform to further absorb energy from the stop.

In particular embodiments, the backrest is pivotably attached to the seat frame with a pivot assembly. The pivot assembly may be biased towards an upright position.

In embodiments, the seat includes a resilient hinge that is formed as a unitary body from a resilient polymer. The seat cushion may be pivotably attached to the seat frame by the resilient hinge. The resilient hinge may have a neutral position and may include a first pair of abutment surfaces that are configured to control a range of motion in a first direction relative to the neutral position. The resilient hinge may include a second pair of abutment surfaces that are configured to control a range of motion in a second direction relative to the neutral position opposite the first direction. The resilient hinge may be attached to the seat frame such that the first direction is the backward direction and the second direction is the forwards direction. A range of motion in the backward direction relative to the neutral position may be less than a range of motion in the forward direction relative to the neutral position.

In some embodiments, the resilient hinge may include an upper surface that is attached to the seat frame and a lower surface that is attached the seat cushion. In the neutral position, the upper surface may form an angle with the lower surface between 5 degrees and 15 degrees.

In particular embodiments, the seat includes a base with the chassis attached to the base. The base may be configured to allow the chassis to rotate relative to the base about a vertical axis. The seat cushion may be capable of motion relative to the seat frame, the backrest may be capable of motion relative to the seat frame, and/or the seat frame may be capable of motion relative to the chassis without motors.

In another embodiment of the present disclosure, a seat includes a chassis, a seat frame, a seat cushion, a backrest, and a resilient hinge. The seat frame is attached to the chassis and the seat cushion and the backrest are each attached to the seat frame. The resilient hinge formed as a unitary body and may be formed from a resilient polymer. The seat cushion and/or the backrest is pivotably attached to the seat frame with the resilient hinge.

In embodiments, the seat cushion is pivotably attached to the seat frame by the resilient hinge and the backrest is pivotably attached to the seat frame by another resilient hinge.

In some embodiments, the resilient hinge has a neutral position and includes a first pair and a second pair of abutment surfaces. The first pair of abutment surfaces may be configured to control a range of motion in a first direction relative to the neutral position. The second pair of abutment surfaces may be configured to control a range of motion in a second direction relative to the neutral position opposite of the first direction. The resilient hinge may be attached between the seat frame and the seat cushion such that the first direction is a reward direction and the second direction is a forward direction. A range of motion in the rearward direction relative to the neutral position may be less than a range of motion in the forward direction relative to the neutral position.

In certain embodiments, the seat frame is connected to the chassis with a front joint and a rear joint. Each of the front and rear joint may be selected from the group consisting of a swing arm and a roller and track combination. The seat frame may be capable of a swinging motion relative to the chassis along a forwards and backward direction of the seat. The front joint may include a front swing arm and the rear joint may include a rear swing arm. The front swing arm may have a top end pivotably attached to the chassis at a first stationary pivot joint and a bottom end pivotably attached to the seat frame at a first floating pivot joint. The rear swing arm may have a top end pivotably attached to the chassis at a second stationary pivot joint and a bottom end pivotably attached to the seat frame at a second floating pivot joint.

In another embodiment, a seat includes a chassis, a seat frame, a seat cushion, a backrest, and a damper. The seat frame is engaged with the chassis and is capable of a swinging motion relative to the chassis along a forward to backward direction of the seat. The seat cushion is attached to the seat frame and the backrest is attached to the seat frame. The damper is configured to limit the swinging motion of the seat frame relative to the chassis in at least one direction. The damper includes a stop and a cushioner. The cushioner is formed form a resilient material and includes a hollow portion with a convex exterior wall that is configured to be inverted by the stop to slow motion of the seat frame in the at least one direction.

In embodiments, the cushioner includes an aperture defined therethrough that is configured to receive a bolt to attach the cushioner to the chassis. The aperture may be offset rom a centerline of the cushioner. The centerline may be parallel with the forward to backward direction of the seat. The cushioner may be mounted to the chassis such that a peripheral wall thereof that does not contact the stop is able to deform to further absorb energy from the stop.

In some embodiments, the seat frame has a forward most and a rearward most position relative to the chassis. The seat may include a spring that biases the seat frame toward the forward most position. The stop may engage the cushioner in the rearward most position. The seat may be pivotably attached to the seat by a resilient hinge. The resilient hinge may be formed as a unitary body from a resilient polymer.

In certain embodiments, the seat frame is connected to the chassis with a front joint and a rear joint that are configured to facilitate the swinging motion. Each of the front and rear joints may be selected from the group consisting of a sing arm and a roller and track combination. The seat frame may be capable of a swinging motion relative to the chassis along a forward to backward direction of the seat. The front joint may include a front swing arm and the rear joint may include a rear swing arm. The front swing arm may have a top end pivotably attached to the chassis at a first stationary pivot joint and a bottom end pivotably attached to the seat frame at a first floating pivot joint. The rear swing arm may have a top end pivotably attached to the chassis at a second stationary pivot joint and a bottom end pivotably attached to the seat frame at a second floating pivot joint.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
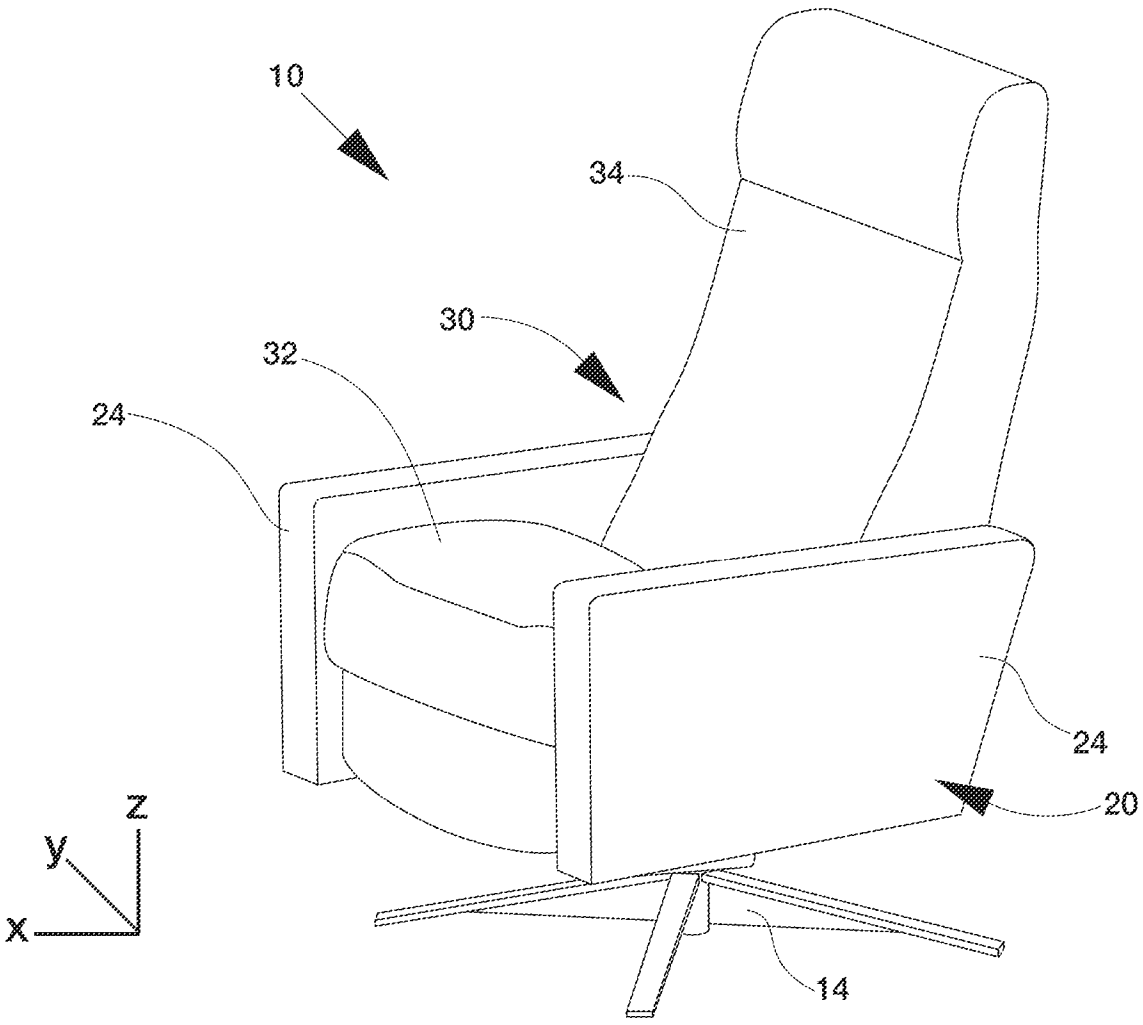
FIG. 1 is a chair according to one embodiment of the present disclosure.

FIG. 1 shows a seat or chair 10 according to one embodiment of the present disclosure. The chair 10, as further described below, is designed to provide micro and macro levels of movement that are generated from movement of the body of the chair's occupant. The chair 10 may then promote movement of the occupant to partially counteract the negative effects of sitting motionless. In one embodiment, the chair 10 may be characterized as a passively moving chair, i.e., a chair that does not require a control interface to adjust the chair. A control interface could include switches connected to motorized elements. In other embodiments, a control interface could include mechanical levers or latches associated with conventional reclining furniture. Instead, the chair 10 may move as the result of the sitter's input through subtle shifts in their body mass, hand-to-armrest leveraging, and foot/leg propulsion.

The chair 10 may be the type that is typically covered in whole or in part by leather or fabric upholstery for furnishing a home or a hospitality environment such as a hotel or business reception area. The chair 10 is shown supported by an optional swivel base 14 that may allow the chair 10 to rotate about a vertical axis normal to a floor upon which the chair is resting. The vertical axis is the Z-axis in FIG. 1. For purposes of clarity for the remainder of this disclosure, the motion that is permitted by the optional swivel base 14 will be ignored. Alternatively, a stationary base (not shown), such as a pedestal or plurality of legs may be provided for supporting the chair 10 on the floor.

Figure 2:
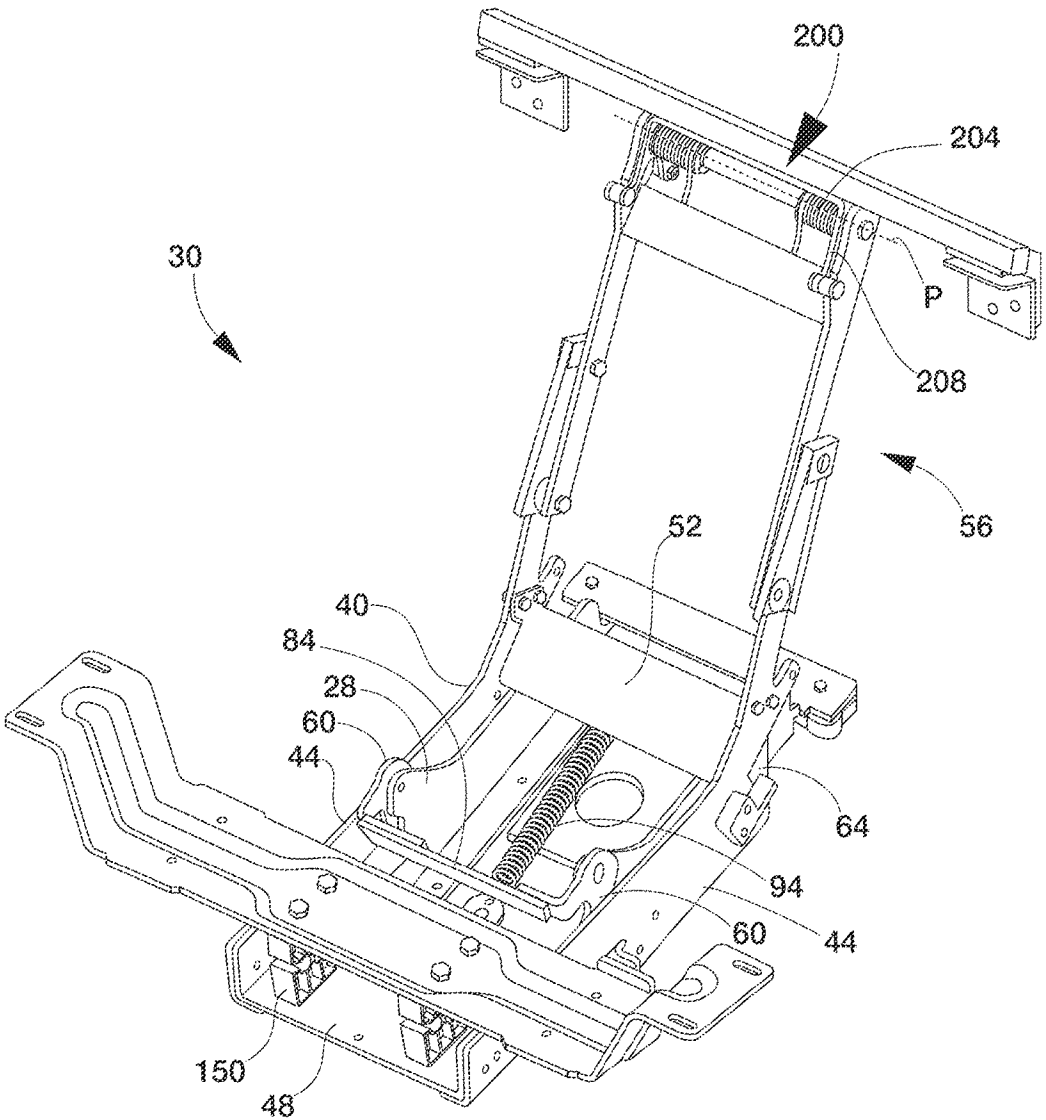
FIG. 2 is a perspective view of select internal components of the chair of FIG. 1.

By ignoring the optional swivel base 14, the chair 10 can be described as having a stationary assembly 20 intended to be stationary relative to the floor. The stationary assembly 20 may include a pair of arms 24 fixed to a chassis 28 (FIG. 2). The chair 10 also includes a motion assembly 30 capable of motion relative to the stationary assembly 20, and therefore capable of motion relative to the floor. The motion assembly 30 includes a seat cushion 32 and a backrest 34.

The chassis 28 may include a base plate for mounting to the optional swivel base 14 and a pair of lateral flanges formed with or attached to the base plate. Where the flanges are separate from and attached to, such as by a plurality of bolts, the base plate, thin gaskets made of rubber or even paper may be provided to avoid metal on metal contact.

As discussed in further detail below, the motion assembly 30 is configured to permit one or more types of motion relative to the floor and the stationary assembly 20. Permitted motion can include a swinging motion of one or both of the seat cushion 32 and backrest 34. As used herein, a "swinging motion" is motion that provides at least some magnitude of translation along a forward and backward direction of the chair 10. The forward and backward direction corresponds with the X-axis as illustrated in FIG. 1.

Permitted motion can also include rotational motion of one or both of the seat cushion 32 and the backrest 34 relative to the stationary assembly 20 or each other. As used herein, "rotational motion" is motion that provides angular movement around a rotational axis as if around a pin. Rotational motion does not itself provide for translation. In the illustrated embodiments provided herein, each of the rotational axes is substantially perpendicular to the forward to backward direction and lies along a plane parallel with the floor. Rotational axes generally extend parallel with the Y-axis as illustrated in FIG. 1. In other embodiments, additional degrees of freedom may be provided to one or both of the seat cushion 32 and backrest 34 relative to the stationary assembly 20 or each other by rotational motion about rotational axes that have a component along the forward and backward direction of the chair.

Figure 3:
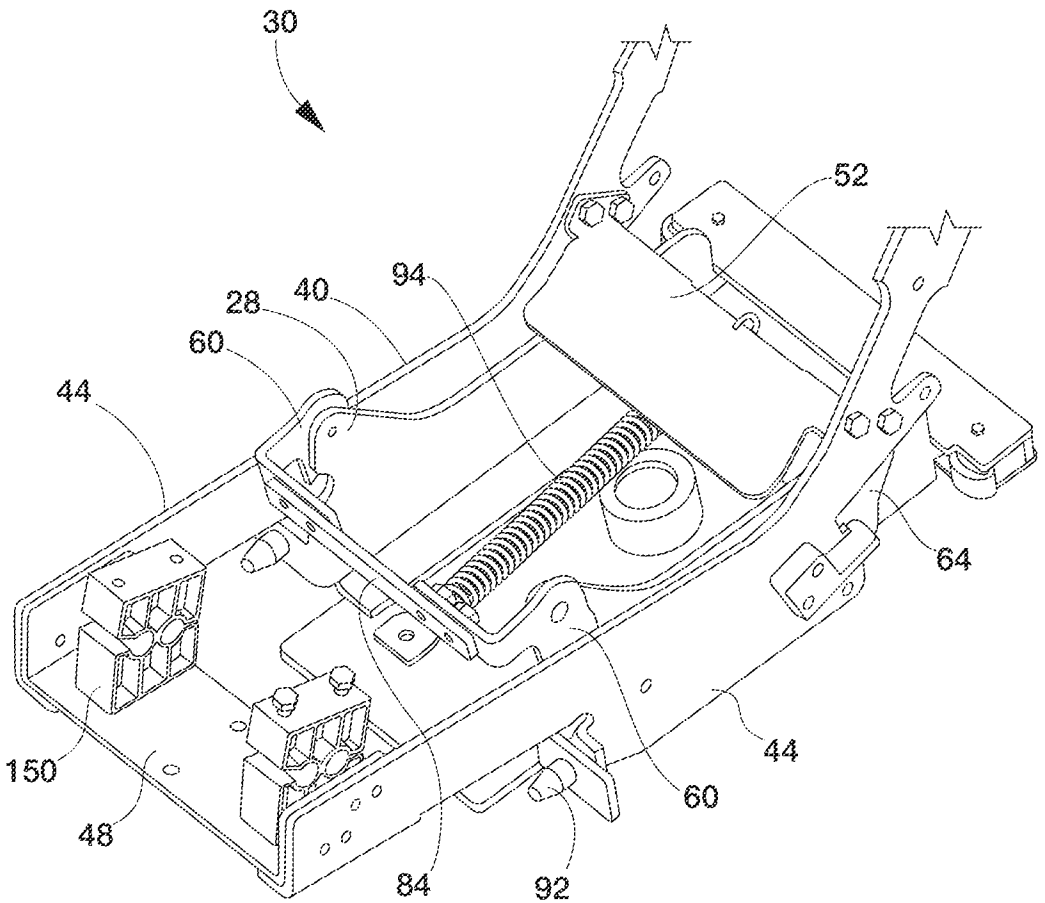
FIG. 3 is a detailed perspective view of select components of FIG. 2.

Turning to FIGS. 2 and 3, select internal components of the chair 10 are illustrated according to one embodiment of the present disclosure. For purposes of illustrating motion components of the chair 10 (FIG. 1), some components have been omitted from FIGS. 2 and 3 as will be understood by one of ordinary skill in the art. For example, the swivel base 14, seat cushion 32, backrest 34, and arms 24 have each been omitted. One of ordinary skill in the art will understand that the arms 24, seat cushion 32, and backrest 34 can be attached to illustrated components directly or indirectly with support bars, bolts, and other conventional methods. In the illustrated example, substantially the entire motion assembly 30 has been packaged below the seat and within a periphery of the backrest 34. In the illustrated example, no moving parts are positioned outside the periphery of the seat cushion 32 and backrest 34 when viewed from the top. In the illustrated embodiment, moving parts are not packaged within the thickness of the arms 24 (FIG. 1). In other embodiments, the thickness of the arms 24 may be used to conceal moving parts, such as the components provided to facilitate the swinging motion as discussed below.

The motion assembly 30 includes the seat cushion 32 and the backrest 34 (FIG. 1), which can be independently attached to a seat or chair frame 40. The chair frame 40 may include a pair of main links 44 positioned on either side of the chassis 28. A front spanner bar 48 may join the pair of main links 44 proximate to the front thereof, and a rear spanner bar 52 may join the pair of main links proximate to the rear thereof. The chair frame 40 can also include a backrest support portion 56 configured to support the backrest 34 (FIG. 1). In the illustrated embodiment of FIG. 2, the backrest support portion 56 is separable from the main links 44 such that the backrest 34 can be disassembled from the chair 10 for delivery. In other embodiments, the main links 44 may be integral with the backrest support portion 56.

The chair frame 40 is attached to the chassis 28 and configured for allowing swinging motion of the chair frame 40 relative to the chassis, and therefore swinging motion between the stationary assembly 20 and the motion assembly 30 (FIG. 1).

Figure 4:
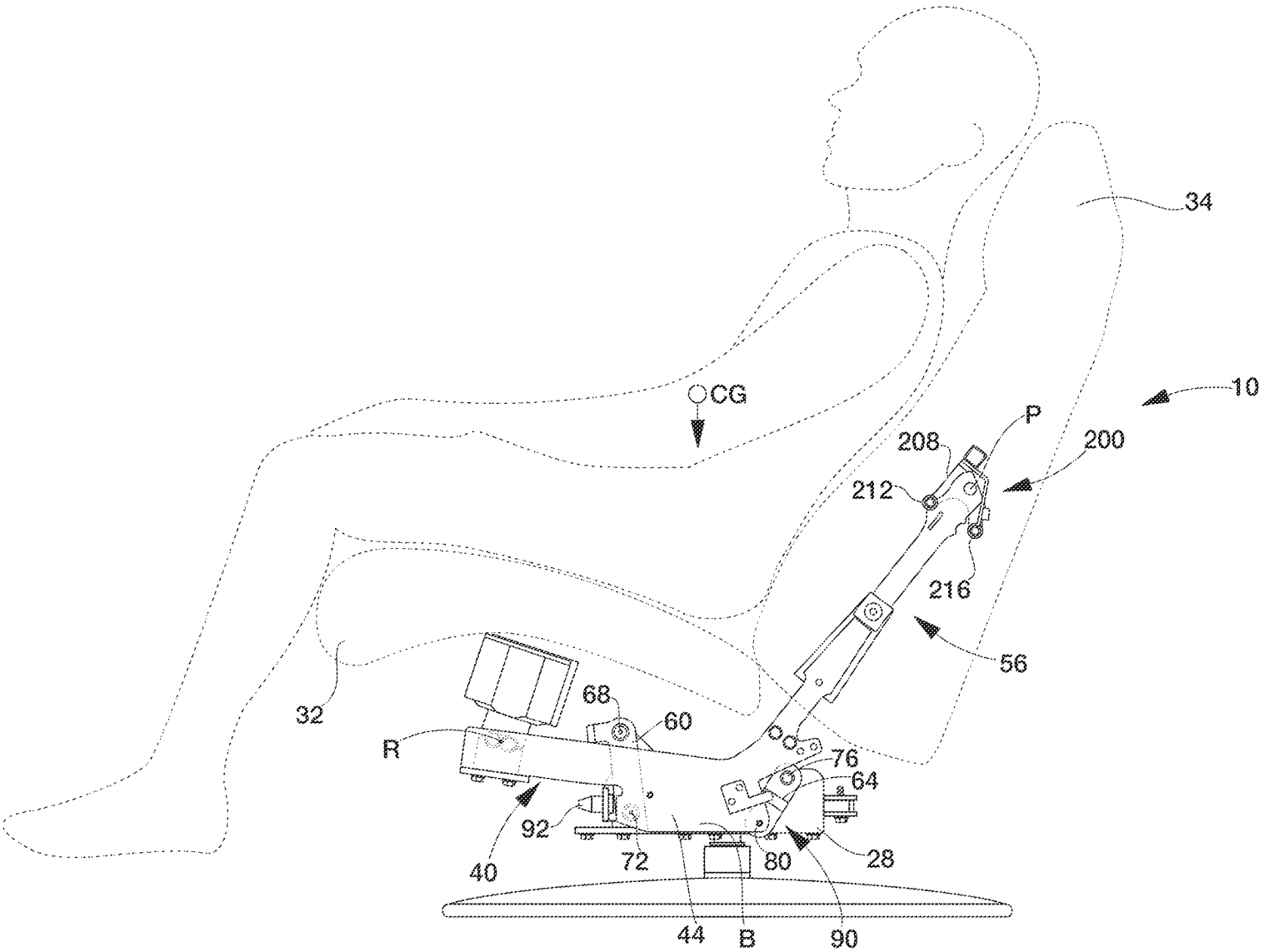
FIG. 4 is a schematic side view of a chair according to the present disclosure in a neutral position.

Turning to FIG. 4, the swinging motion between the chassis 28 and the chair frame 40 may be facilitated by a front swing arm 60 and a rear swing arm 64 on each of the main links 44. A top end of the front swing arm 60 is pivotably attached to the chassis 28 at a front stationary pivot joint 68, and a bottom end of the front swing arm is pivotably attached to the main link 44 at a front floating pivot joint 72. A top end of the rear swing arm 64 is pivotably attached to the chassis 28 at a rear stationary pivot joint 76, and a bottom end of the rear swing arm is pivotably attached to the main link 44 at a rear floating pivot joint 80. The illustrated configuration results in the chair frame 40 being relatively suspended from the chassis 28, which allows gravity to assist the swinging motion of the chair frame.

As will be understood from FIGS. 2 and 3, there may be two sets of swing arms 60, 64, one set for each of the main links 44. To help maintain timing of the swing of the two main links 44, a stretcher bar 84 may be used to join the two front swing arms 60. The stretcher bar 84 adds rigidity to the structure and avoids twisting or sheer motion, referred to as racking, between the pair of main links 44.

Returning to FIG. 4, the front and rear swing arms 60, 64 combined with main link 44 and the chassis 28 form a four-bar system 90. The length of each swing arm 60, 64 between its respective stationary and floating pivot joints, the pre-determined separation distance between the stationary pivot joints 68, 76, and the predetermined separation distance between the floating pivot joints 72, 80 all combine to define the swing motion of the chair frame 40 relative to the chassis 28.

In the illustrated embodiment, the front swing arm 60 is about 8.7 cm long, the rear swing arm 64 is about six cm long, the stationary pivot joints 68, 76 are about nineteen cm apart and the floating pivot joints 72, 80 are about fourteen cm apart. The example embodiment may be stated more generally as a front swing arm 60 that is longer, as measured between pivot joints, than a rear swing arm 64, and a distance between stationary pivot joints 68, 76 that is longer than a distance between floating pivot joints 72, 80. The example embodiment may be further generalized as swing arms of different lengths that are not parallel to one another as defined by the segments connecting the pivot joints of the swing arms respectively.

The example geometry has been found to provide an advantageous swing motion for the chair frame 40 relative to the chassis 28. The swing motion of the illustrated embodiment is designed to provide a significant rocking component, where the angle between the seat cushion 32 and backrest 34 can remain constant while the forward end of the seat is raised and the top end of the backrest 34 is lowered. Thus, while the four-bar system 90 is described herein as providing a swinging motion, the sitter may experience a sensation more strongly associated with rocking backward on the rear legs of a conventional stationary chair than a clearly perceived forward and backward translating motion.

FIG. 4 shows the chair frame 40 in a neutral position. The neutral position may also be referred to as an upright position. The neutral position is the position of the chair frame 40 relative to the chassis 28 when a user is not seated within the chair 10. In the neutral position, the chair frame 40 may be at or near its forwardmost position relative to the chassis 28. In the illustrated embodiment, the forwardmost position of the chair frame 40 relative to the chassis 28 is limited by contact between the forward swing arm 60 and a forward stop 92 attached to or formed with the chassis 28. The forward stop 92 may include a rubber bumper or other structures known in the motion furniture art to reduce noise and absorb shock when limiting the motion of a moving part. When shifted rearwardly, the chair frame 40 may be biased toward the neutral position by a return spring 94 (FIG. 2).

The chair 10 is designed to be balanced in the neutral position with and without an occupant. Balance occurs because the chair 10 is designed to position the center of gravity of the sitter CG in substantial vertical aligned with the balance point B of the motion mechanism 30 when the sitter assumes an active, upright posture. The four-bar system 90 is also designed for allowing the substantial vertical alignment of the center of gravity CG and the balance point B to be maintained even as the front of the seat cushion 32 rises and the top of the backrest 34 lowers during a first portion of the rearward swing of the four-bar system 90.

Figure 5:
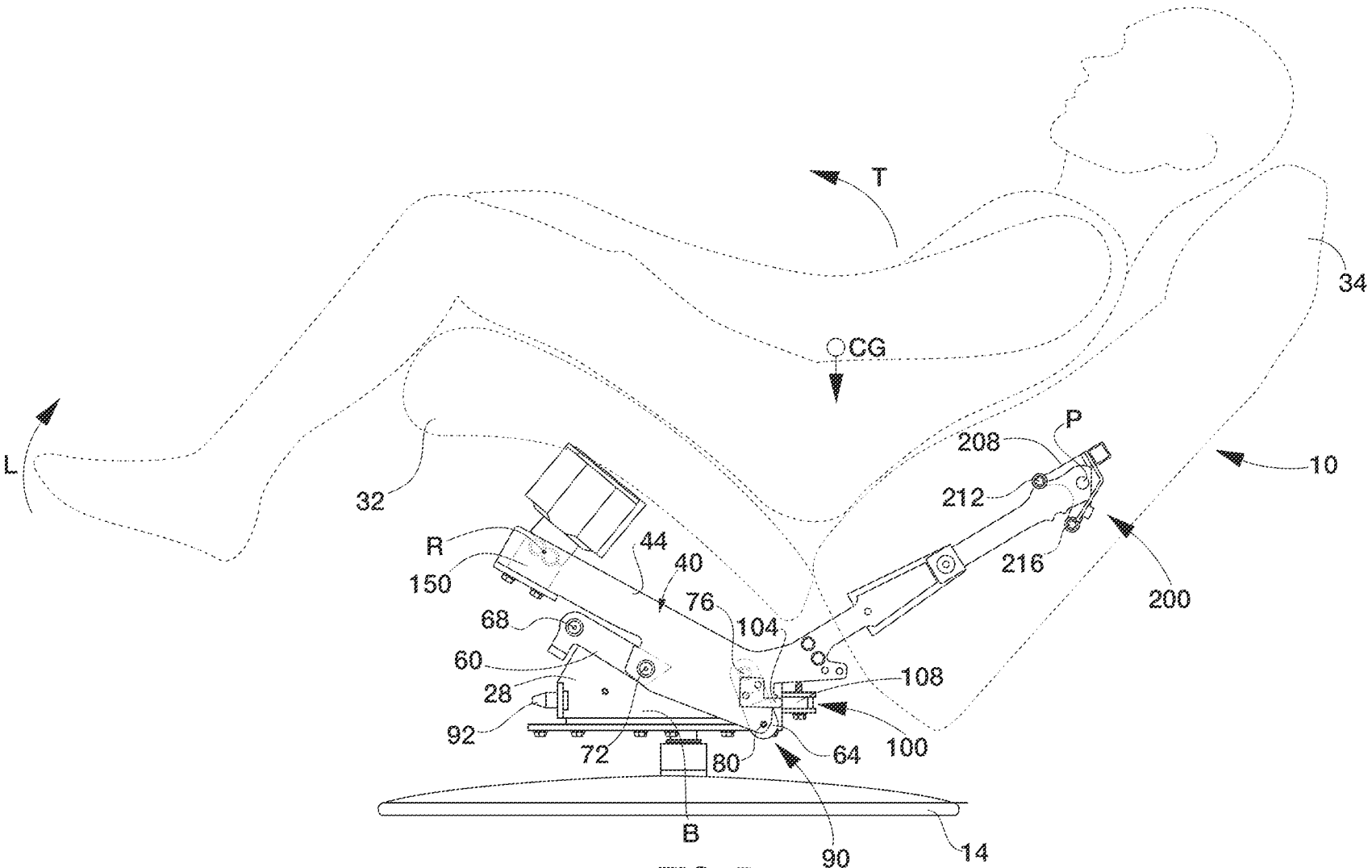
FIG. 5 is a schematic side view of a chair according to the present disclosure in a reclined position.

FIG. 5 shows the chair frame 40 in a reclined position. The illustrated reclined position corresponds with a rearwardmost position of the chair frame 40 relative to the chassis 28. While a first portion of the rearward swing of the four-bar system 90 from the neutral position may be unstable, biasing the motion mechanism 30 back to neutral, the rearwardmost position of the chair frame 40 illustrated may provide a stable over-center position of the chair frame 40 where the sitter may be able to comfortably remain in the illustrated position. In an over-center position, the raised pelvis and lower extremities of the sitter shift the center of gravity CG significantly rearward of the balance point B. The chair frame 40 may arrive softly at the rearwardmost position with the help of a damper 100 comprised of a stop 104 attached to the main link 44 and a cushioner 108 attached to the chassis 28.

Figure 6A:
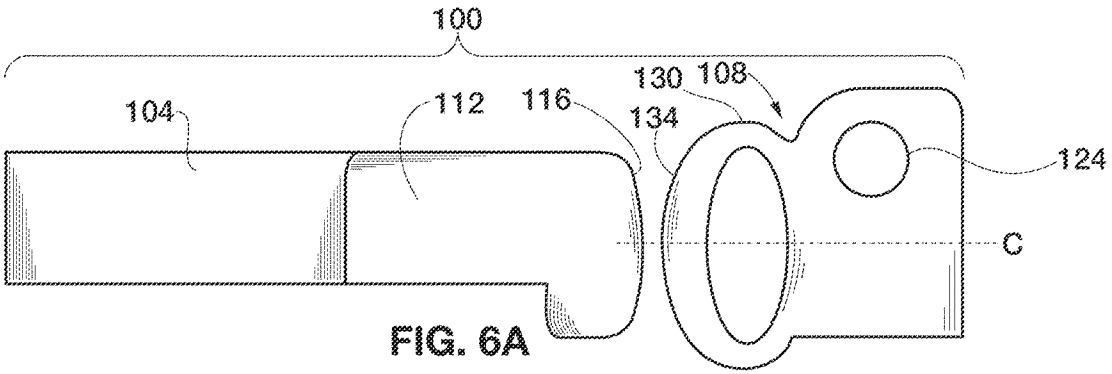
FIGS. 6A, 6B, and 6C illustrate successive positions of the damper.
Figure 6B:
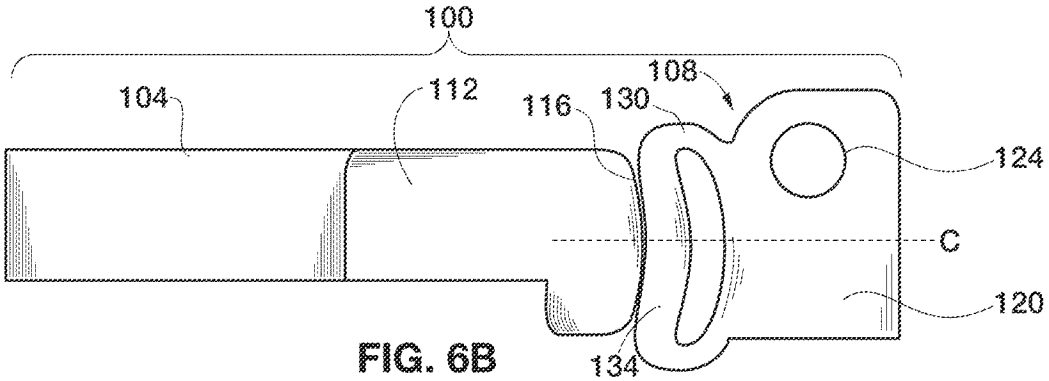
Figure 6C:
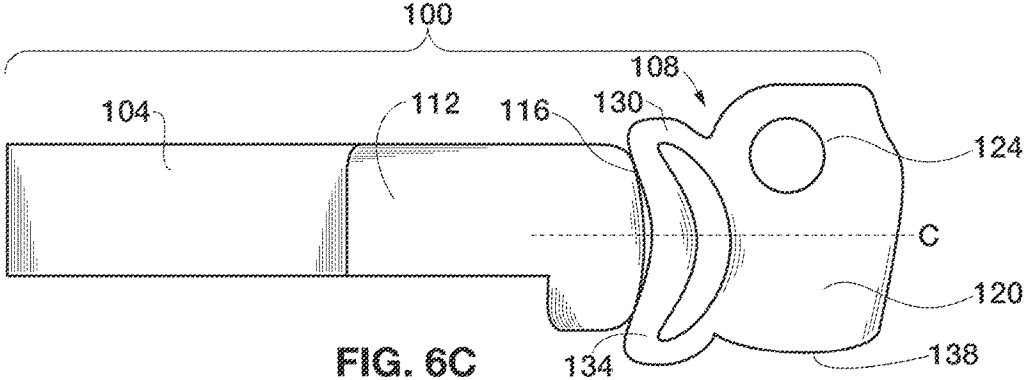

FIGS. 6A-6C illustrate a top view of the damper 100 in a separated position, a first damping position, and a second damping position respectively. In the example embodiment, the stop 104 is a rigid member, such as aluminum. The stop 104 includes an actuating portion 112 with a rearward distal end 116 of the stop having a rounded convex surface profile configured to contact the cushioner 108. The curved shape of the distal end 116 helps avoid wear on the cushioner 108. The geometry of the distal end 116 is also selected to be approximately congruent with the configuration assumed by the cushioner 108 upon contact from the stop 104.

The cushioner 108 may be a unitary body formed of resilient hyper elastic material, such as elastomeric polymers, for example Hytrel® 5556 available from DuPont. The unitary body may have an attachment portion 120 configured for use to join the cushioner 108 to the chassis 28. The attachment portion 120 may include an aperture 124 for receiving a bolt. In one embodiment, the aperture 124 is offset from the central axis C of the cushioner 108. The central axis C of the cushioner 108 may bisect the surface of the distal end 116 of the stop 104. The unitary body may also have a head portion 130. The head portion 130 is designed to be hollow. The head portion 130 is an oval or elliptical shape, which provides an initially convex exterior receiving wall 134.

As illustrated in FIG. 6B the rearward distal end 116 of the stop 104 is arranged to press upon the receiving wall 134. The force applied by the stop 104 is designed to invert the receiving wall 134 into a concave shape that corresponds with the shape of the rearward distal end 116 of the stop. The inversion of the receiving wall 134 absorbs energy and increases the time of impact to more slowly limit the rearward motion of the chair frame 40 relative to the chassis 28 (FIG. 5).

As illustrated in FIG. 6C, the damper 100 provides a second phase, soft stop of the motion of the chair frame 40 because the cushioner 108 is resilient. Even after the receiving wall 134 is inverted, the cushioner 108 may further absorb energy by further deforming. The cushioner 108 can be mounted to the chassis 28 in a manner that allows at least one peripheral wall 138 of the attachment portion 120 to deform as the stop 104 continues to imping upon the cushioner.

When the chair frame 40 releases in a forward direction, the resilient properties of the material forming the receiving wall 134 are intended to return the receiving wall to its natural convex shape.

To return the sitter from the reclined position of FIG. 5 to the neutral position of FIG. 4, the sitter may shift their center of mass by lifting their lower leg as indicated by the arrow L. This shift in the sitter's body can cause the motion mechanism 30 to respond by articulating in the forward direction. Similarly, the sitter may lift their head and torso as indicated by the arrow T using either their core muscles or by pulling forward on the arms of the chair 10. This movement of the sitter's body can also produce the necessary shift in mass to leverage the mechanism to respond by articulating in a forward direction.

Returning to FIGS. 2 and 3, the chair 10 according to embodiments of the present disclosure may be configured for relative motion other than provided between the chair frame 40 and the chassis 28. In the illustrated embodiment, the seat cushion 32 is attached to the chair frame 40 with one or more resilient hinges 150, which permit rotational motion between the seat cushion 32 and the chair frame 40. Motion of the seat cushion 32 relative to the chair frame 40 can be independent of motion between the chair frame and the chassis 28. In the illustrated embodiment, a pair of resilient hinges 150 are mounted to the front spanner bar 48 for supporting the seat cushion 32 (FIG. 1).

As shown in FIG. 4, a rotation axis R of the resilient hinge 150 is positioned to be forward of the center of gravity CG of a person seated in the chair 10 in the neutral position.

Figure 7:
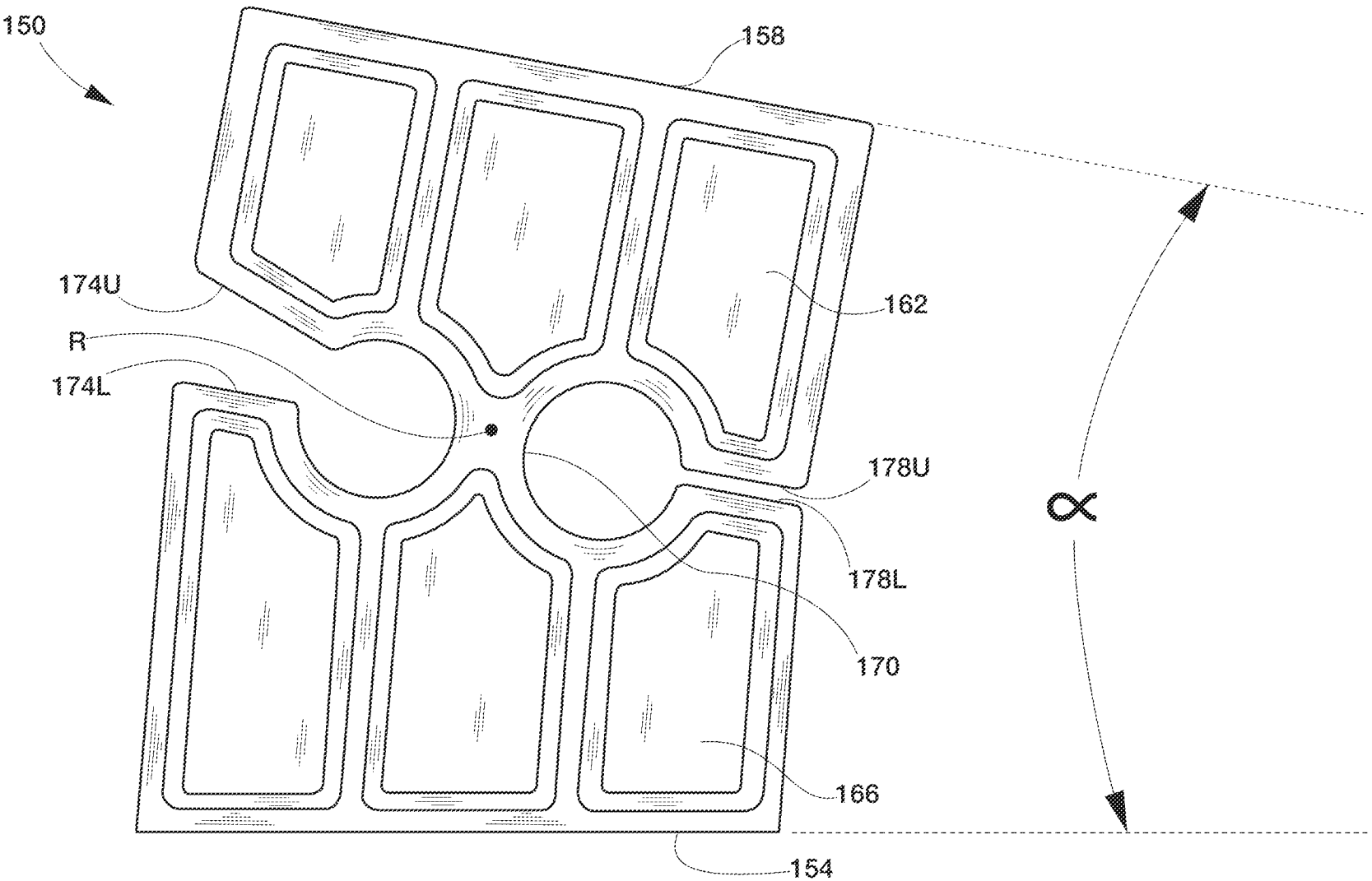
FIG. 7 is a side view of a resilient hinge according to an embodiment of the present disclosure.

FIG. 7 shows a detailed side view of the resilient hinge 150 in a neutral position. The neutral position is defined by the natural state of the resilient hinge 150 when not being subject to forces external to the chair. The resilient hinge 150 may have a bottom surface 154, which is attached the chair frame 40 for being capable of following the swinging motion thereof. The resilient hinge 150 also includes a top surface 158, which is opposite the bottom surface 154, and is configured to directly or indirectly support the seat cushion 32. In the neutral position, the top and bottom surfaces 154, 158 define an angle $\alpha$ therebetween. The angle $\alpha$ may define, in whole or in part, the angle of the seat cushion 32 relative to the floor when the user is not in the chair. When the chair 10 is upright, the seat cushion 32 may be favorably positioned with a front of the seat higher than a rear of the seat by an angle between about five and about fifteen degrees relative to the floor. Therefore, the angle $\alpha$ between the top surface 154 and the bottom surface 158 of the resilient hinge 150 may also be configured to be between about five and about fifteen degrees in the neutral position.

The resilient hinge 150 is configured as a solid state hinge designed as a unitary body for replacing multiple component assemblies. The resilient hinge 150 is made from a resilient material capable of flexing under the influence of external forces and returning to an initial position upon removal of the external forces. In one embodiment, the resilient hinge 150 is made from resilient hyper elastic material, such as elastomeric polymers, for example Hytrel® 7246 available from DuPont. Hytrel® may be preferred because of its hyper elastic properties and resistance to creep, such that the resilient hinge 150 will continue to return to the neutral position after a significant number of use cycles.

The resilient hinge 150 may be formed of a unitary construction with a process such as injection molding or additive manufacturing.

The resilient hinge 150 of FIG. 7 includes an upper mass 162 and a lower mass 166 that are integrally connected by a web 170. The web 170 extends along the thickness direction of the resilient hinge 150 and defines a rotational axis R that extends along the web such that the upper mass 162 is able to pivot relative to the lower mass 166 about the rotational axis R as the material of the web flexes. The resilient material forming the web 170 stores energy as it is flexed by external forces. The web 170 therefore acts like a spring that returns the resilient hinge 150 toward the neutral position after the external forces are reduced or removed. The resilient material of the web 170 also provides for substantially rotational motion without a rigid pin, contributing to a softer, more fluid motion.

In order to control the magnitude of pivoting motion between the upper mass 162 and the lower mass 166, each mass is provided with a forward abutment surface 174U, 174L and a rearward abutment surface 178U, 178L. Relative to the neutral position shown in FIG. 7, rearward pivoting motion is limited upon contact between the rearward abutments surfaces 178U, 178L. Relative to the neutral position, forward pivoting motion is limited upon contact between the forward abutment surfaces 174U, 174L. In one embodiment, relative to the neutral position, the magnitude of permitted pivot in the rearward direction is less than the magnitude of permitted pivot in the forward direction. In one example, the rearward abutment surfaces 178U, 178L are spaced apart by about 0.06" in the neutral position, allowing for approximately 1 degree of rotation of the seat cushion 32 in the rearward direction beyond neutral. In one embodiment, the forward abutment surfaces 174U, 174L are spaced apart by about 0.3" in the neutral position, allowing for approximately 20 degrees of rotation of the seat cushion 32 in the forward direction relative to neutral. In one embodiment, the magnitude of permitted forward pivoting motion of the seat cushion 32 is configured such that the seat can achieve a position substantially parallel with the floor. In another embodiment, the seat cushion 32 may be permitted to tilt in a forward direction relative to the floor.

Returning to FIG. 2, even further motion can be provided to the chair 10 using a pivot assembly 200 for attaching the backrest 34 to the chair frame 40. In some embodiments (see FIG. 9), the pivot assembly 200 can be replaced by a resilient hinge 150. The pivot assembly 200 can be configured to permit rotational motion between the backrest 34 and the chair frame 40. The pivot axis P of the pivot assembly 200 is configured to be positioned approximately adjacent to the T10 and T11 vertebra of the spine of an adult male sitting upright in the chair 10.

In one embodiment, the pivot assembly 200 is a spring biased pivot assembly that includes one or more torsion springs 204. The torsion springs 204 are configured to bias the backrest 34 to the neutral, upright position shown in FIG. 4. The pivot assembly 200 may include a guide 208. In the illustrated embodiment, the guide 208 is configured to rotate with the backrest 34 and control the range of motion of the pivot assembly 200. The guide 208 includes a forward stud 212 and a reward stud 216 that may each be fitted with a rubber bushing for damping and noise reduction. The studs 212, 216 may be configured to contact the backrest support portion 56 to limit rotational motion of the backrest 34. In the illustrated embodiment, the neutral position of the pivot assembly 200 corresponds to the most upright position of the backrest 34 with the forward stud 212 engaged with the backrest support portion 56.

Figure 8:
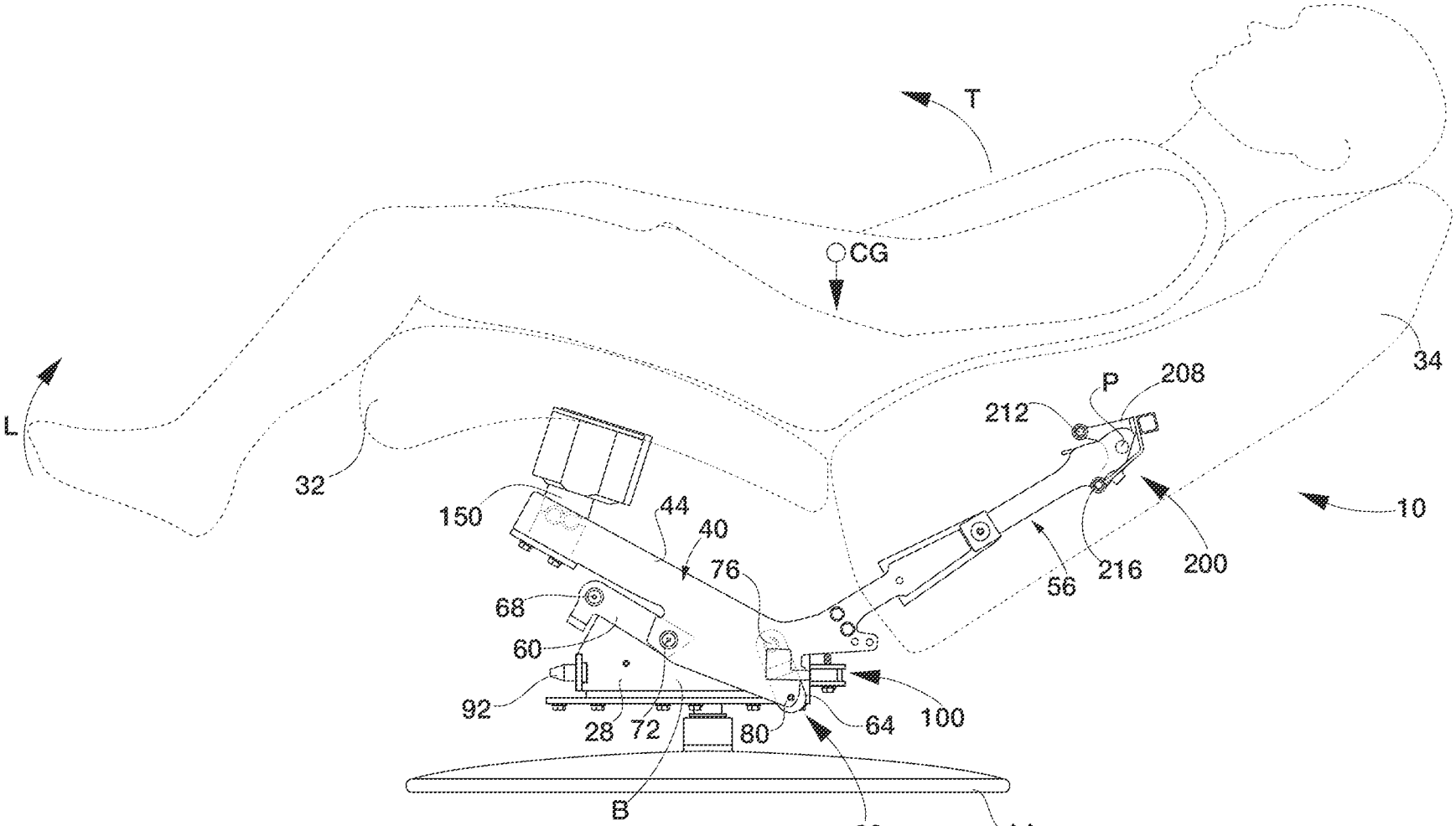
FIG. 8 is a schematic side view of a chair according to the present disclosure in a laid out position.

FIG. 8 shows the chair 10, including the backrest 34, in a laid out position. In the laid out position, the resilient hinge 150 can be pivoted forward as shown. In the laid out position, the pivot assembly 200 may be pivoted rearward with the rear stud 216 engaged with the backrest support portion 56. In an embodiment, the guide 208 is configured to provide the pivot assembly 200 with a range of motion of about twenty degrees. This range was selected because it enables the sitter to engage in a broad range of back positions from upright to reclined. These postures support activities that people often engage in while seated, from human-to-human conversation, TV watching, reading, and resting. The laid out position may be obtained by the sitter opening their core muscles, stretching the distance between the knees and the shoulders of the sitter. The sitter may also use their hands to press rearwardly on the arms 24 (FIG. 1) to assist their core muscles.

In addition to the macro posture adjustments illustrated by comparing FIGS. 4, 5, and 8, the pivot assembly 200 and resilient hinge 150 also provide nuanced micro-posture shifting to help continuously adjust the seat cushion 32 and backrest 34 to the posture of the sitter. For example, inhalation and exhalation can cause the chest to expand and contract, which can cause the pivot assembly 200 to articulate.

The ability for the user to create the desired macro and micro posture adjustments is impacted by the center of gravity of the chair 10 as well as the center of gravity of the user. The ability of the user to provide pressure on the chair 10, as well as the overall height and weight of the user can result in slight differences in the user experience when sitting in the chair. For this reason, various aspects of the chair 10 may be adjusted to offer a chair 10 that is tuned to the user. For example, users under about 5' 8" tall may benefit from a different sized chair than those users 6" tall and above. Changes to the chair to fit the shorter user in a smaller chair may include reducing the height of the backrest 34, reducing the depth of the seat cushion 32, and reducing the height of the chassis 28 above the ground. Additionally, the arms (FIG. 1) may be mounted closer together to provide a more narrow chair. In one embodiment, weighted plates may be attached to the seat cushion 32 of a chair for a larger individual to balance the chair 10 and help the chair return to the proper neutral position after the user has left the chair.

Many of the components and assemblies described above may be useful individually in various chair embodiments to provide improved form and function over the prior art in terms of simplicity, manufacturability, durability, and cost. Perceived quality, attributable to low noise, reduced racking, and soft stops, can also be improved using the individual components and assemblies described above. Examples of advantageous individual components and assemblies include the four-bar system 90, damper 100, resilient hinge 150, and pivot assembly 200.

In addition, the individual components and assemblies described above combine in whole or in part to create a motion chair 10 that is able to allow the user to achieve a significant number of seating positions configured to associate with the human form as the result of the motion and application of force by the user, without requiring motors or otherwise powered mechanisms.

Figure 9:
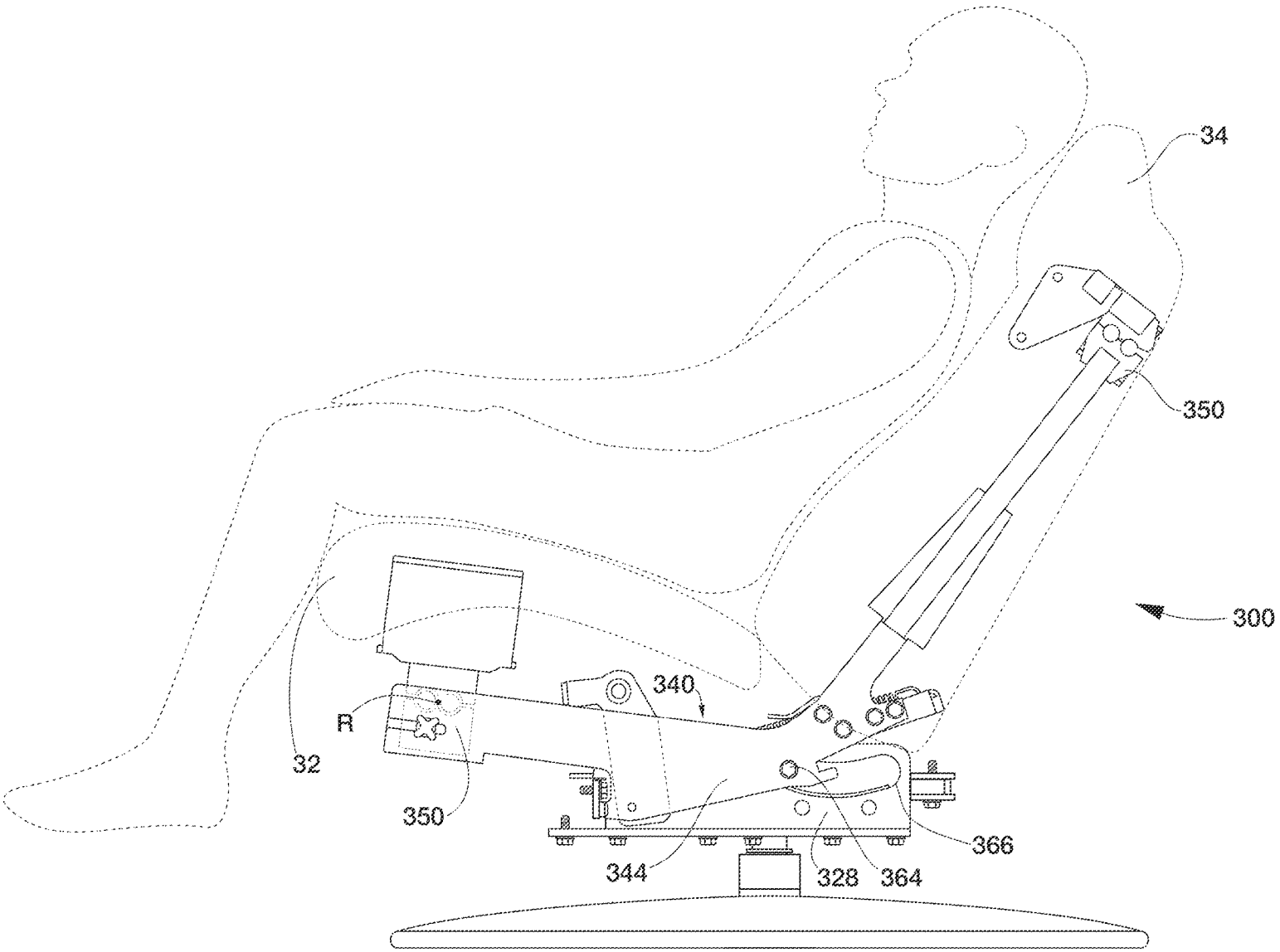
FIG. 9 is a schematic side view of a chair according to a second embodiment of the present disclosure in the neutral position.

FIG. 9 shows another embodiment of a chair 300 having substantially the same functionality and motion profile as the chair 10 described above. The chair 300 includes a resilient hinge 350 supporting both the seat cushion 32 and the backrest 34 in place of the pivot mechanism 200 (FIG. 2). The front spanner bar (not shown) of the chair 300 may be adjustably attached to the main link 344 of the chair frame 340. This adjustability is able to move the rotational axis R of the seat cushion 32 relative to the user. This adjustment results in being able to fine-tune the chair to the body of the user.

The chair 300 may be most notably distinct from the chair 10 of FIG. 4 as the result of replacing the rear swing arm 64 (FIG. 4) with a track mechanism. The main link 344 can include a roller 364 rotatably attached thereto. The chassis 328 is provided with a track 366 for slidably receiving the roller 364 therein. The track 366 may be slot configured such that the roller 364 follows a single fixed path along the track. The shape of the track 366 may be selected with the intent that the path of the roller 364 will follow the same path as the rear floating pivot joint 80 of the chair 10 (FIG. 4).

Figure 10:
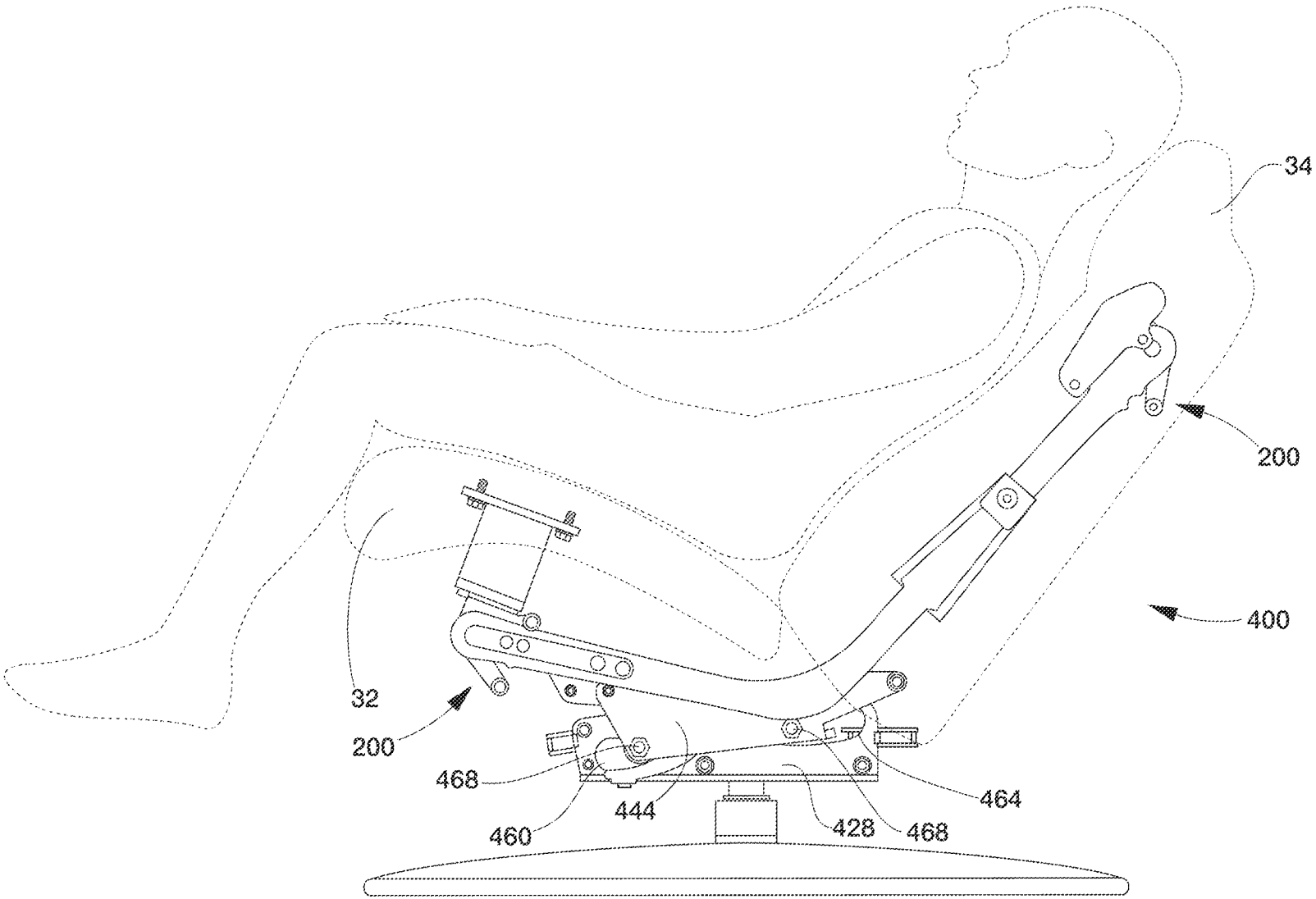
FIG. 10 is a schematic side view of a chair according to a third embodiment of the present disclosure in the neutral position.

FIG. 10 illustrates a chair 400 according to a third embodiment of the present disclosure. The chair 400 replaces both swing arms 60, 64 of the chair 10 (FIG. 4) with track mechanisms. The chassis 428 includes a front track 460 and a rear track 464. Each track may comprise a slot for receiving a respective roller 468 that extends from the main link 444. Each roller 468 may slidably fit within the respective tracks 460, 464 to follow a single fixed path of motion along the track.

Figure 11:
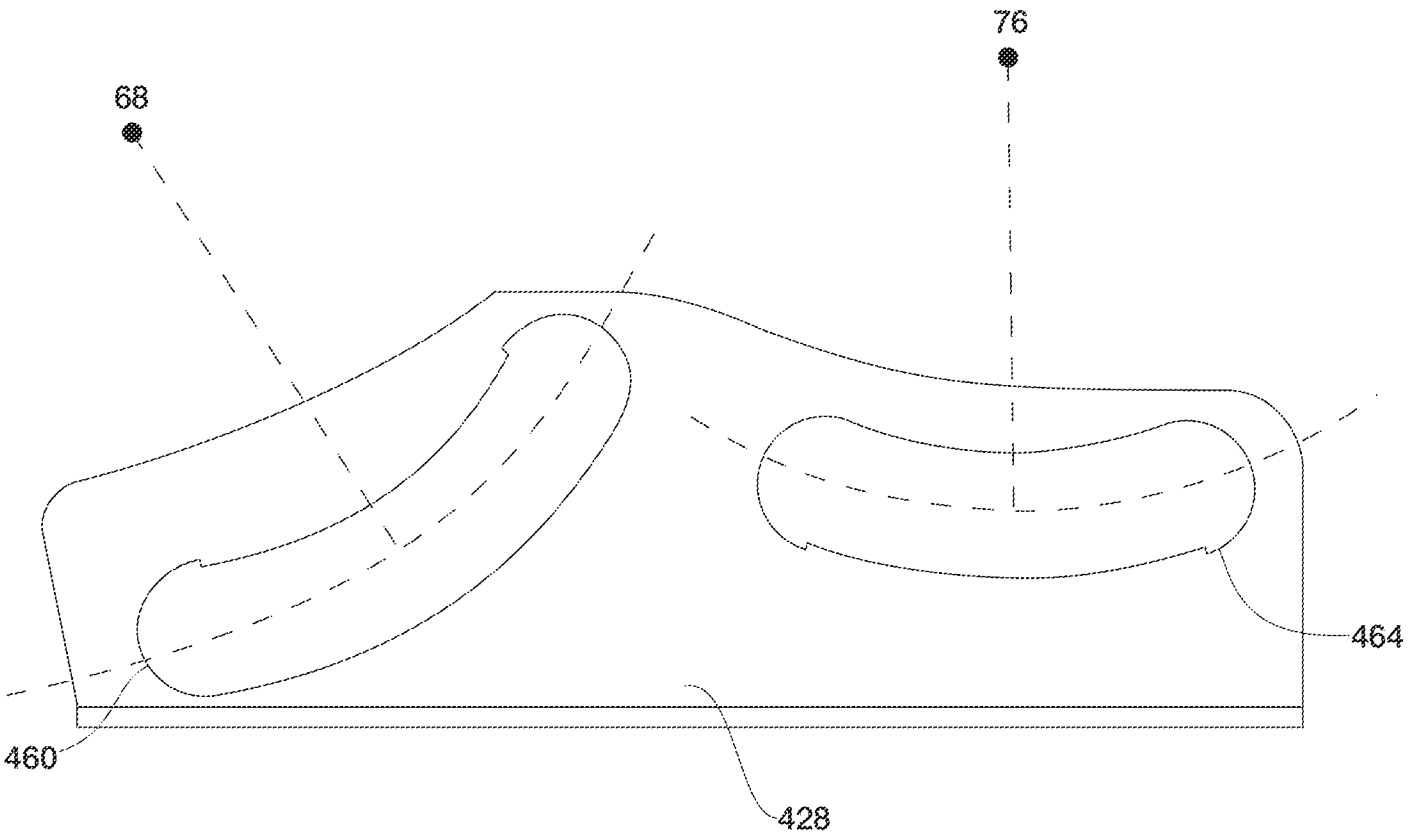
FIG. 11 is a detailed side view of the chassis of the chair of the third embodiment.

As possibly best shown in FIG. 11, the curves defined by the front track 460 and the rear track 464 may be intentionally distinct. The curves defined by each track may be specifically designed to mirror the swing motion created by the floating pivot joints 72, 80 of the chair 10 (FIG. 4). Specifically, both tracks 460, 464 may define circular arcs with their radius and center of curvature selected to mirror the relative location of the stationary pivot joints 68, 76 of the chassis 28 (FIG. 1). Also, in FIG. 11, the left side corresponds with a forward position and the right side corresponds with a rearward position. The tracks 460, 464 therefore illustrate that rearward motion of the chair frame 440 (FIG. 11) will cause upward movement of a roller 468 (FIG. 11). One skilled in the art will then appreciate that gravity will assist to bias the roller and therefore the chair frame downward and forward back toward the neutral position.

In another distinction between the chair 10 (FIG. 4) and the chair 400 as shown in FIG. 10, the chair 400 may also replace the resilient hinge type joints between the chair frame 440 and the seat cushion 32 and backrest 34 respectively with spring based pivot assemblies 200 as discussed above with respect to the chair 10.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

What is claimed:

1. A seat, comprising:
a chassis;
a frame;
a seat cushion; and
a first resilient hinge formed as a solid-state hinge, comprising:
a lower mass coupled to the frame;
an upper mass; and
a web connecting the upper mass to the lower mass such that the upper mass and the lower mass are moveable relative to one another,
wherein the seat cushion is operably coupled to the chassis by the first resilient hinge such that the seat cushion is moveable relative to the chassis.

2. The seat according to claim 1, wherein the upper mass includes a front abutment surface and a rear abutment surface configured to constrain movement of the seat cushion relative to the chassis.

3. The seat according to claim 2, wherein the web connects to the upper mass between the front abutment surface and the rear abutment surface.

4. The seat according to claim 2, wherein the web flexes toward the rear abutment surface as the seat cushion moves rearward relative to the chassis, and
wherein the web flexes toward the front abutment surface as the seat cushion moves forward relative the chassis.

5. A seat, comprising:
a chassis;
a frame;
a seat cushion; and a first resilient hinge formed as a solid-state hinge, comprising:

a lower mass;

an upper mass; and a web connecting the upper mass to the lower mass such that the upper mass and the lower mass are moveable relative to one another a backrest coupled to the frame by a second resilient hinge formed as a solid-state hinge, wherein the seat cushion is operably coupled to the chassis by the first resilient hinge such that the seat cushion is moveable relative to the chassis.

6. The seat according to claim 1, wherein the frame comprises a pair of planar links, the first resilient hinge coupled to the frame between the pair of planar links.

7. A chair, comprising:

a chassis;

a frame;

a seat including a backrest, the seat or the backrest coupled to the frame by the resilient hinge; and a first resilient hinge formed as a unitary body, comprising:

a first mass having a front abutment surface and a rear abutment surface;

a second mass movable relative to the first mass; and a web connecting the first mass to the second mass, wherein the seat is operably coupled to the chassis by the first resilient hinge such that the seat is moveable relative to the chassis, movement of the seat relative to the chassis constrained by the front abutment surface and the rear abutment surface of the first mass.

8. The chair according to claim 7, further comprising a second resilient hinge, the seat or the backrest coupled to the frame by the second resilient hinge such that the seat and the backrest move relative to the chassis independently relative to one another.

9. The chair according to claim 7, wherein the seat is moveable relative to the chassis between a neutral position, a forward-most position, and a rearward-most position, wherein movement of the seat toward the rearward-most position is constrained by the rear abutment surface of the first resilient hinge, and wherein movement of the seat toward the forward-most position is constrained by the front abutment surface of the first resilient hinge.

10. The chair according to claim 7, wherein the second mass of the first resilient hinge is coupled to the frame.

* * * * *